US005178557A

United States Patent [19]

Hashiguchi

[11] Patent Number: 5,178,557

[45] Date of Patent: Jan. 12, 1993

[54] ELECTRIC CONNECTOR HAVING SYMMETRIC LOCKING BLOCKS AT OPPOSITE ENDS

[75] Inventor: Osamu Hashiguchi, Tokyo, Japan

[73] Assignee: Japan Aviation Electronics Industry, Limited, Tokyo, Japan

[21] Appl. No.: 785,270

[22] Filed: Oct. 30, 1991

[30] Foreign Application Priority Data

Oct. 31, 1990 [JP] Japan ..... 2-113443[U]
Jan. 16, 1991 [JP] Japan ..... 3-4166[U]

[51] Int. Cl.[5] ..... H01R 13/627; H01R 13/73
[52] U.S. Cl. ..... 439/357; 439/570
[58] Field of Search ..... 439/350-358, 439/563, 570, 573, 564

[56] References Cited

U.S. PATENT DOCUMENTS 3,394,337 7/1968 Miller ..... 439/353
4,057,879 11/1977 Eigenbrode ..... 439/358
4,702,542 10/1987 Noyes ..... 439/357
4,842,542 6/1989 Davis ..... 439/357

FOREIGN PATENT DOCUMENTS 2538396 3/1976 Fed. Rep. of Germany ..... 439/357

*Primary Examiner*—Gary F. Paumen
*Attorney, Agent, or Firm*—Laff, Whitesel, Conte & Saret

[57] ABSTRACT

An electric connector is provided with an insulator which includes a base section provided with a main face, electrically conductive contacts arranged on the main face of the base section, a coupling section accommodating the contacts, and end blocks formed on both ends of the base section. Each end block is provided with a receiving face parallel to the main face, a mounting face normal to the main face and a receiving space extending normal to the receiving face. A locking block is detachably received within the receiving space for locking engagement with a mating connector. The locking block is provided with a hook projecting from the receiving face for locking engagement with the mating connector, and the first and the second slots to be placed in engagement with a hook pin used for securing the connector to a circuit board. Alternatively, the end block may be provided with a cutaway extending in an opposite surface to the receiving face in combination with a side slot formed in the locking block for receiving an edge of the circuit board.

6 Claims, 6 Drawing Sheets

ELECTRIC CONNECTOR HAVING SYMMETRIC LOCKING BLOCKS AT OPPOSITE ENDS

BACKGROUND OF THE INVENTION

The present invention relates to an electric connector and, more particularly, to improvement in construction of an electric connector for interface application in a connector unit made up of two mating connectors.

A typical construction of the conventional electric connector for interface application is comprised of a main body, a frame coupled to the main body and a metallic shell coupled to the frame. The main body includes an insulator and a number of electrically conductive contacts incorporated into the insulator. On each end of the frame, are provided a mounting portion and a hook. The mounting portion is adapted for mounting the frame onto a substrate such as a circuit board whereas the hook is adapted for locking a mating connector in the assembled state together with the connector.

In the case of the conventional electric connector of the above-described construction, the main body and the frame are manufactured separately. In addition, the frame is made of a metallic material with the mounting portions and the hooks in one body. According to the construction, different sizes of main bodies and frames have to be prepared for different connectors accommodating different numbers of contacts. To suffice this requirement in use, a number of different metallic molds must be reserved in production. This causes cumbersome parts control in use and innegligible increase in moulding cost. Further, use of metallic material for the frame unavoidably increases the total weight of the conductor unit. In addition, insertion of the main body into the frame in fabrication inevitably results in a large-sized construction of the connector unit.

SUMMARY OF THE INVENTION

It is thus the primary object of the present invention to provide a novel type construction of an electric connector in which connector parts are used in common to connector units of different contact numbers, thereby reducing number of parts to be prepared in use, cost on metallic molds to be reserved in manufacture, and the size and weight of the connectors.

In accordance with the present invention, an electric connector comprises an insulator which includes a central base section, a coupling section formed on the base section for coupling with a counterpart connector, and a pair of side blocks formed on both lateral ends of the base section. The side block has a coupling face extending normal to the coupling plane and a receiving space extending normal to the coupling face. A plurality of contacts are attached to the coupling section of the insulator. A pair of locking blocks are received in the receiving spaces in the side blocks of the insulator and each locking block has a hook projecting form the coupling face for locking engagement with the counterpart connector. Means is provided for detachable locking each locking block in each receiving space in the insulator.

DESCRIPTION OF THE PREFERRED EMBODIMENTS

For better understanding of the present invention, the following description is first directed to a typical example of the conventional electric connector for interface application.

Figure 1:
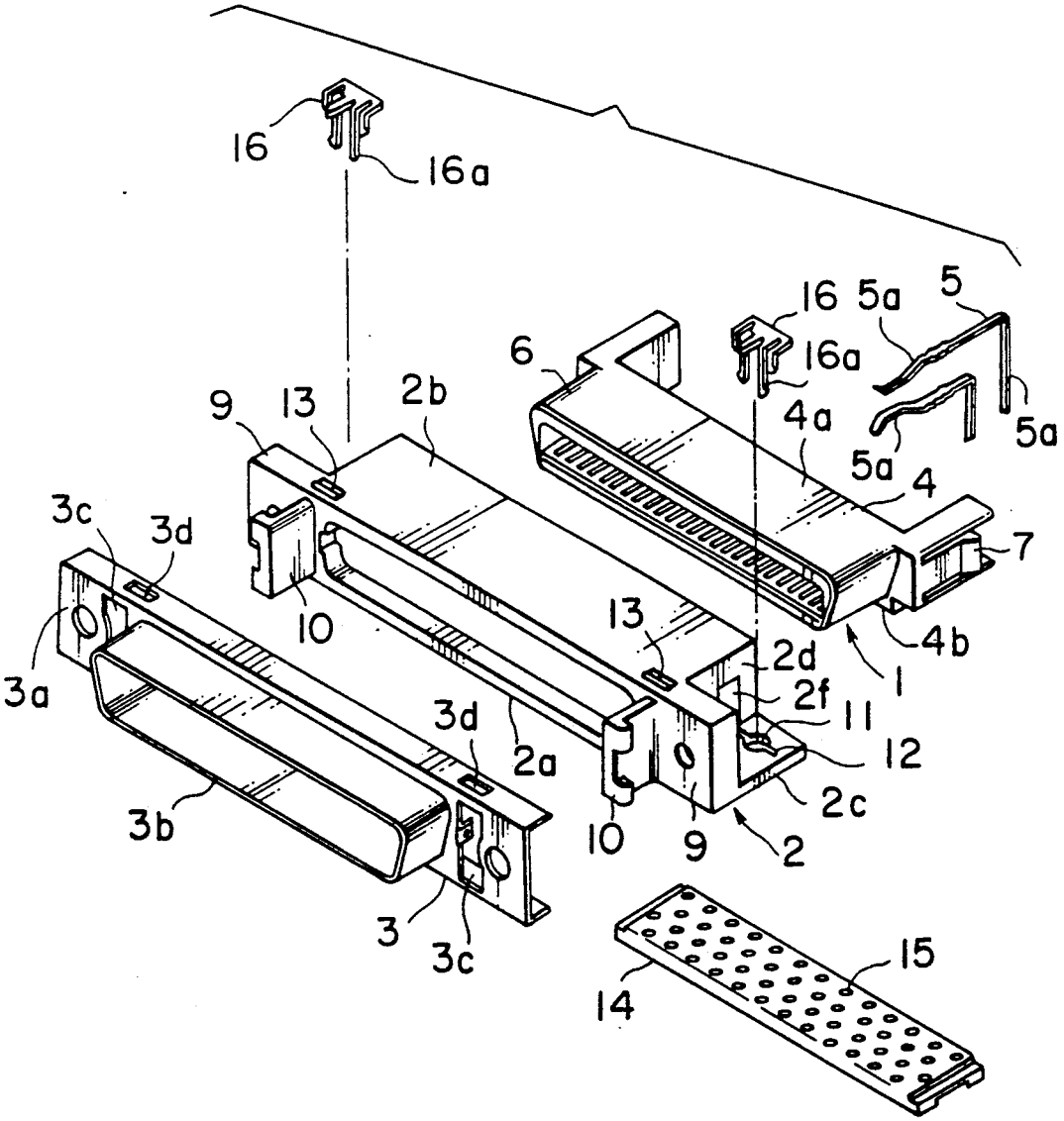
FIG. 1 (PRIOR ART)
FIG. 1 is a perspective view, in a disassembled state, of a typical example of the conventional electric connector for interface application.
Figure 2:
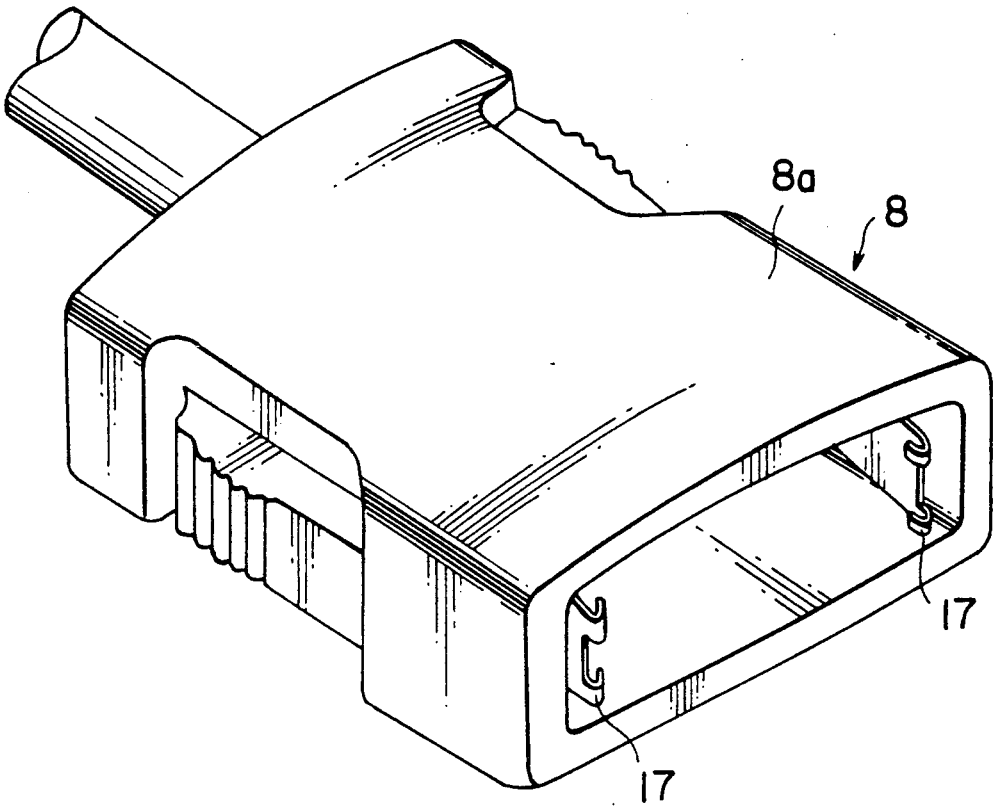
FIG. 2 (PRIOR ART)
FIG. 2 is a perspective view of an example of a mating connector to mate with the electric connector shown in FIG. 1.

In FIGS. 1 and 2, the electric connector is comprised of, as major elements, a main body 1, a frame 2 coupled to the main body 1 and a metallic shell 3 attached to the frame 2.

The main body 1 comprises an insulator 4 and a plurality of electrically conductive contacts 5 incorporated into the insulator 4. The insulator 4 comprises a base section **4*a*, a coupling section 6 provided on a main face 4*b* of the base section 4*a* and engaging sections 7 provided on opposite ends of the base section 4*a*. The engaging sections 7 extend opposite to the coupling section 6**.

Each of contacts 5 is made to have a contact section **5*a* adapted for contact with a counterpart contact arranged on the mating connector 8 shown in FIG. 2. The contact 5 is further includes a terminal 5*b* formed in one body with and bent from the contact section 5*a*. The contacts 5 are incorporated into the insulator 4 so that the contact sections 5*a* are arranged in two tiers, in the case of the illustrated example, in the region of the coupling section 6 of the insulator 4**.

The frame 2 is provided with a frame section **2*b* so that, when combined with the insulator 4, the coupling section 6 of the insulator 4 extends from its face 2*a* which is parallel to the main face 4*b* of the insulator 4. On each side of the frame section 2*b*, the frame 2 is provided with a mounting portion 9 extending parallel to the face 2*a* and accompanied with a mounting portion 2*c* which extends normal to the mounting portion 9. The frame 2 is further provided with a pair of hooks 10 on the face 2*a*. Each mounting portion 2*c* is provided with a screw hole 11 for fixing the frame 2 to a circuit board (not shown) and a slot 12 extending across the screw hole 11**.

The metallic shell 3 is provided with a plate section **3*a* which, when combined with the frame 2**, faces the face 2*a* and the mounting portion 9 of the frame 2. The plate section 3*a* is accompanied with a frame section 3*b* for covering the coupling section 6 of the insulator 4. Near each opposite end, the plate section 3*a* is provided with a through hole 3*c* for reception of the corresponding hook 10 on the frame 2.

When the main body 1 is coupled to the frame section 2*b* of the frame 2 in assembly, the engaging sections 7 come into engagement with engaging holes 2*f* formed in the opposite ends 2*d* of the frame 2 so that the main body 1 is locked to the frame 2. The shell 3 is coupled to the frame 2. More specifically, each hook 10 on the frame 2 engages a through hole 3*c* in the metallic shell 3 and each projection 13 on the frame 2 comes into engagement with a locking hole 3*d* in the shell 3.

The electric connector assembled with the main body 1, the frame 2 and the shell 3 is then mounted at the bottom face of the mounting portion 2*c* onto the circuit board via a locator 14. The locator 14 is provided with a number of perforations 15 for reception of the terminals 5*b* of the individual contacts 5 in the main body 1.

Then, a hook pin 16 is inserted into the slot 12 in the mounting portion 2*c* on the frame 2 and its leg 16*a* is locked to a corresponding hole in the circuit board. As an alternative for the hook pin 16, a bolt may be inserted through the screw hole 11 in the mounting portion 2*c* for screw engagement with the circuit board.

The coupling section 6 of the main body 1 receives the mating connector 8 associated with the cable. As shown in FIG. 2, the mating connector 8 is provided with an insulating hood 8*a* which covers contacts for connection with the contacts 5 in the main body 1. A pair of locking flaps 17 are provided inside the hood 8*a* of the mating connector 8 for locking engagement with the hooks 10 on the frame 2.

The above-described conventional connector has problems as described in the preamble.

Now, description is made as to an embodiment of the electric connector in accordance with the present invention.

Figure 3:
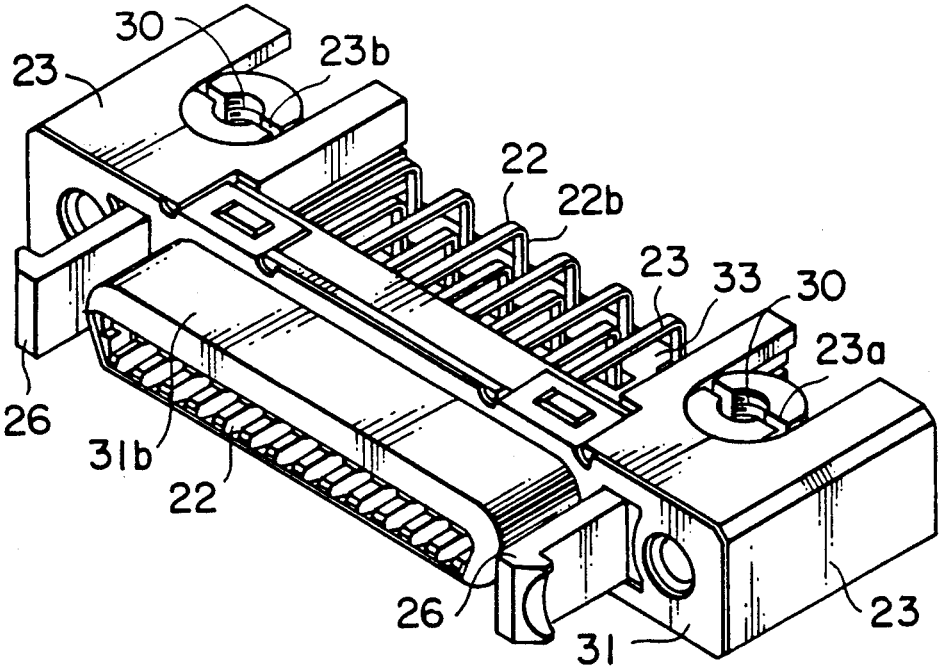
FIG. 3 is a perspective view, in an assembled state, an electric connector according to one embodiment of the present invention.
Figure 4:
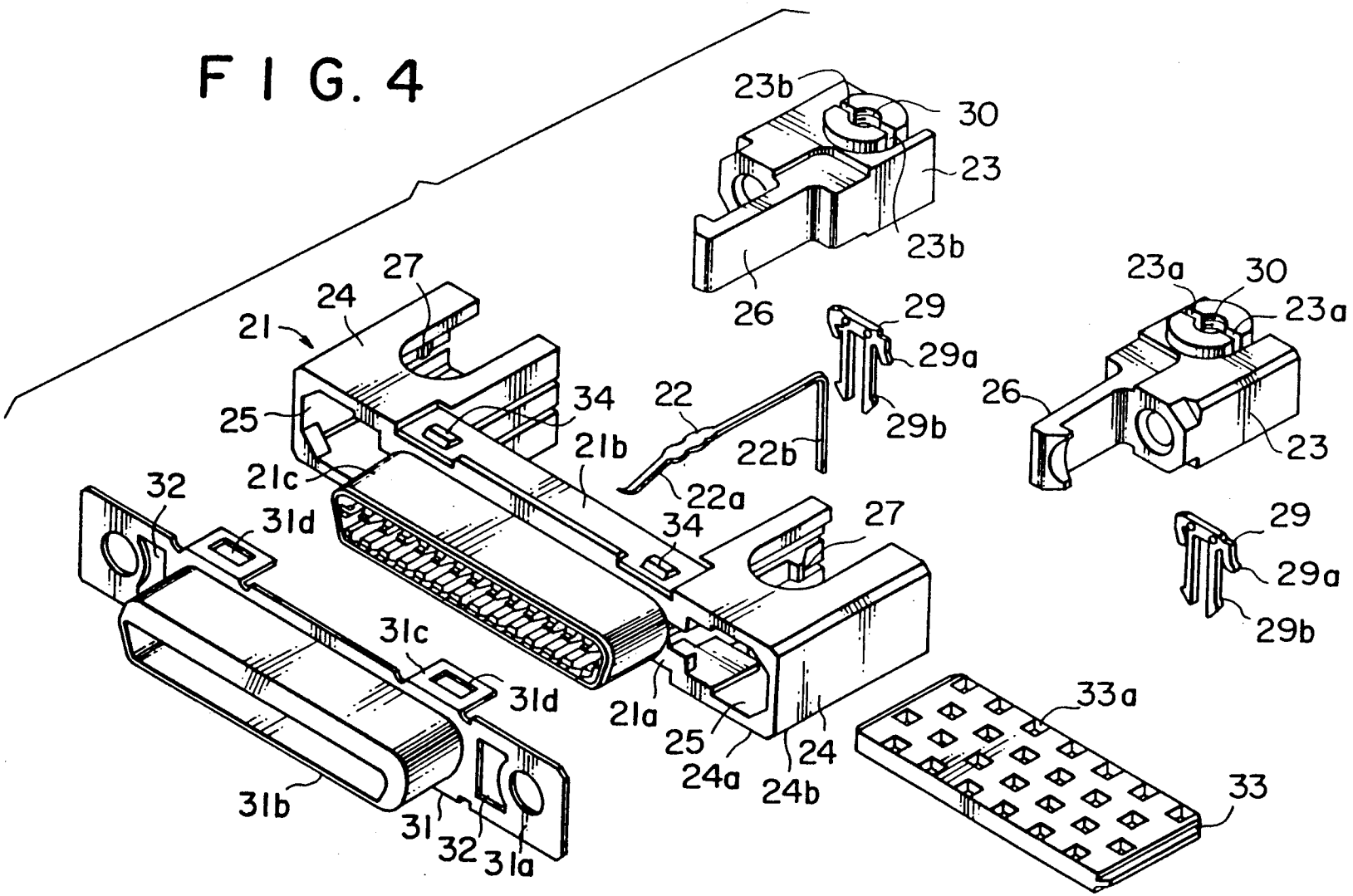
FIG. 4 is a perspective view, in a disassembled state, of the electric connector shown in FIG. 3.
Figure 5:
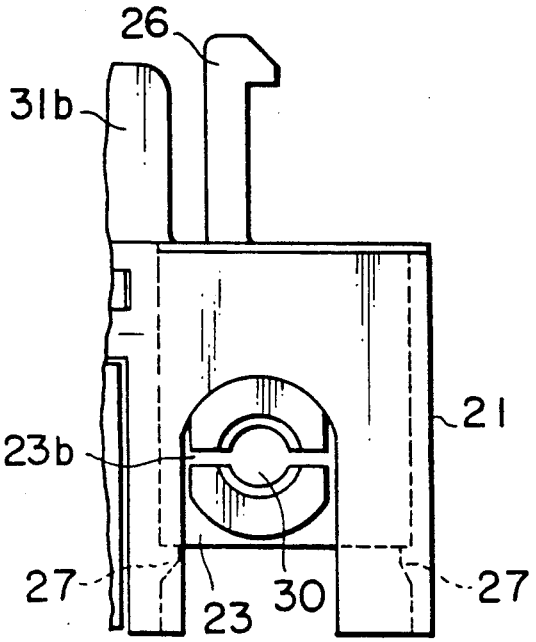
FIG. 5 is a plan view of the main part of the electric connector shown in FIG. 3.

Referring to FIGS. 3 to 5, the electric connector includes, as major elements, an insulator 21, a plurality of electrically conductive contacts 22 attached to the insulator 21 and a locking block 23 detachably coupled to the insulator 21.

The insulator 21 comprises a base section 21*b* with a main face 21*a*, a coupling section 21*c* formed on the main face 21*a* of the base section 21*b* and a pair of end blocks 24 provided on opposite ends of the base section 21*b*. The end block 24 has a receiving face 24*a* parallel to the main face 21*a*, a mounting face 24*b* normal to the main face 21*a* and a receiving space 25 extending normal to the receiving face 24*a*.

The contact 22 comprises a contact section 22*a* and a terminal 22*b* connected to one end of the contact section 22*a*. The contacts 22 are mounted to the coupling section 21*c* of the insulator 21 with their contact sections 22*a* arranged in two parallel tiers. The receiving space 25 in the end block 24 detachably receives the locking block 23.

The locking block 23 is provided with a hook 26 for locking the mating connector (see FIG. 2) coupled to the coupling section 21*c* of the insulator 21. That is, the hook 26 of the locking block 23 projects from the receiving face 24*a* of the end block 24.

The end block 24 and the locking block 23 are provided with means for detachably engaging them with each other. More specifically, engaging flaps 27 are formed on side wall of the receiving space 25 whilst extending normal to the coupling face 24*a*. The engaging flap 27 has elasticity in construction and is forced to open slightly sideways when the locking block 23 is inserted into the receiving space 25. As the locking block 23 is fully received within the receiving space 25, the engaging flap 27 resumes its original position due to its elastic recovery.

Figure 6:
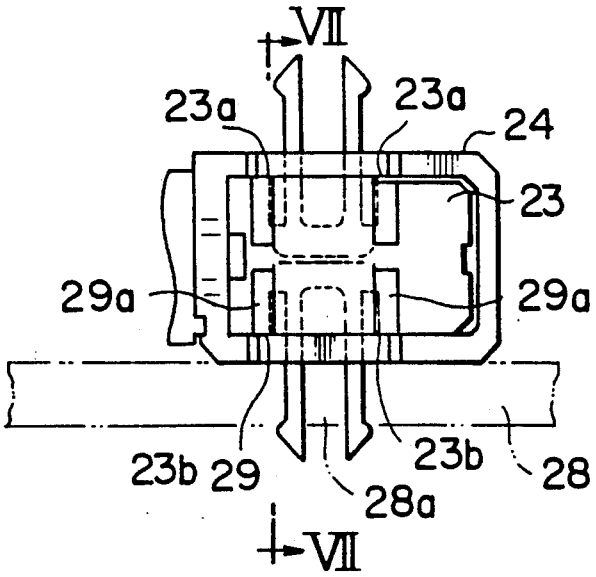
FIG. 6 is a sectional view of the electric connector secured to a circuit board.
Figure 7:
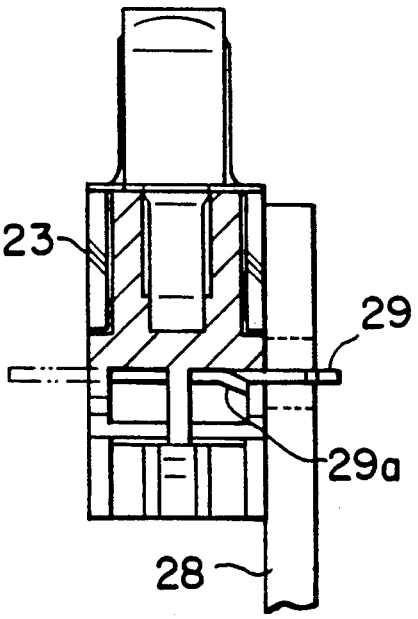
FIG. 7 is a sectional view taken along a line VII—VII in FIG. 6.
Figure 8:
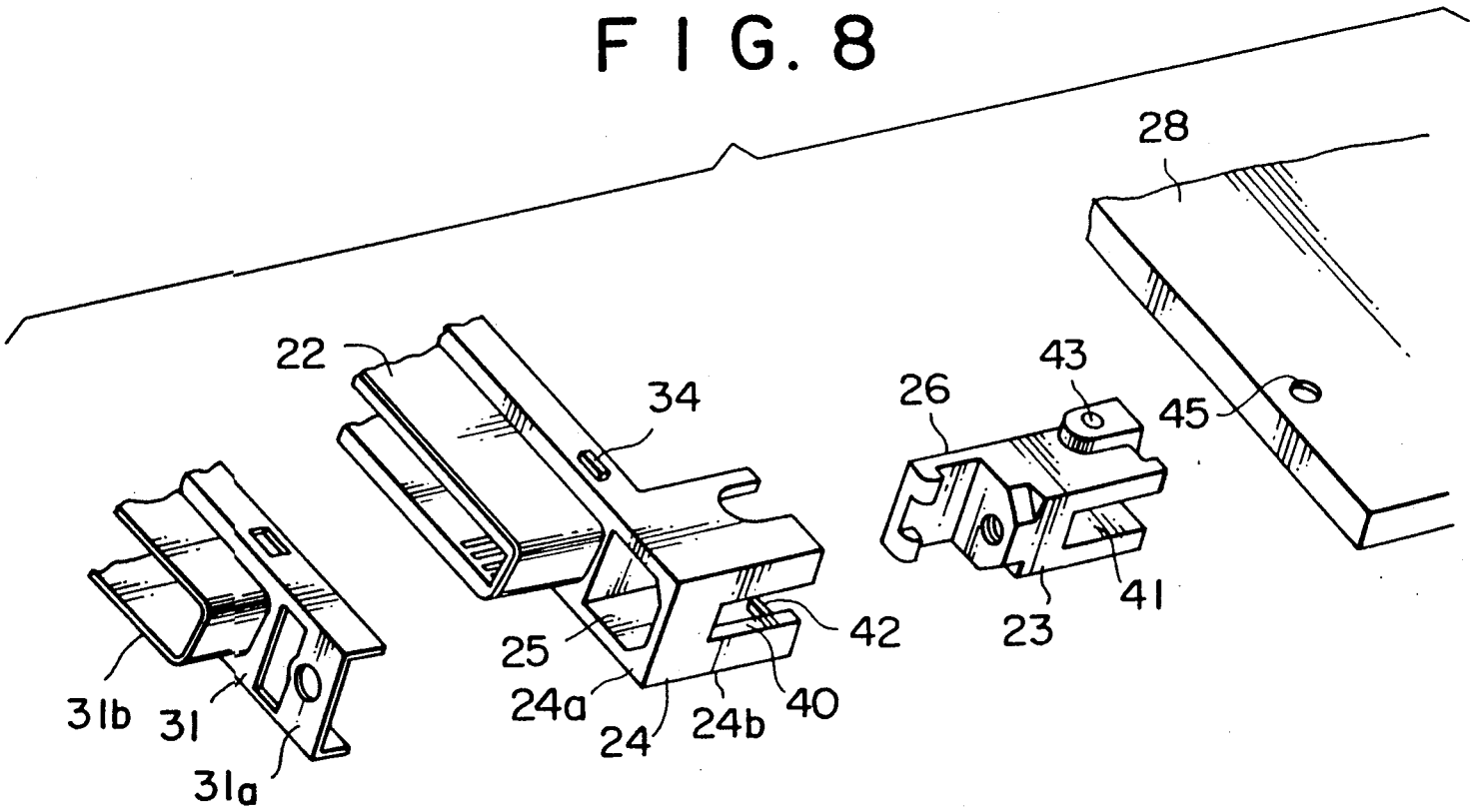
FIG. 8 is a perspective view, in a disassembled state, of an electric connector according to another embodiment of the present invention.
Figure 9:
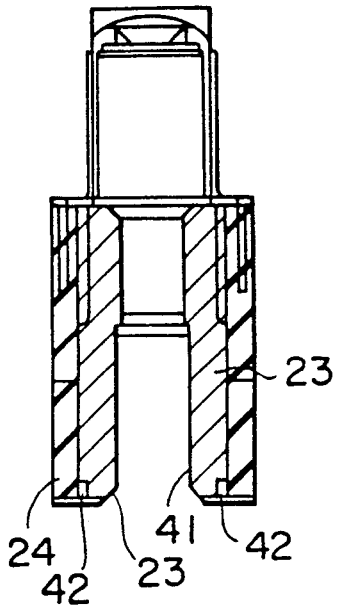
FIG. 9 is a sectional view of a locking block in a position coupled to an insulator.
Figure 10:
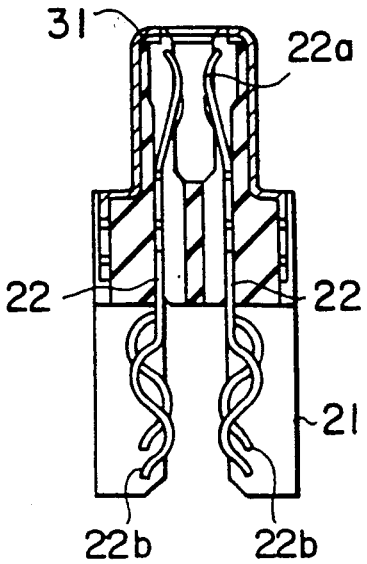
FIG. 10 is a sectional view of a coupling part of the insulator shown in FIG. 8.
Figure 11:
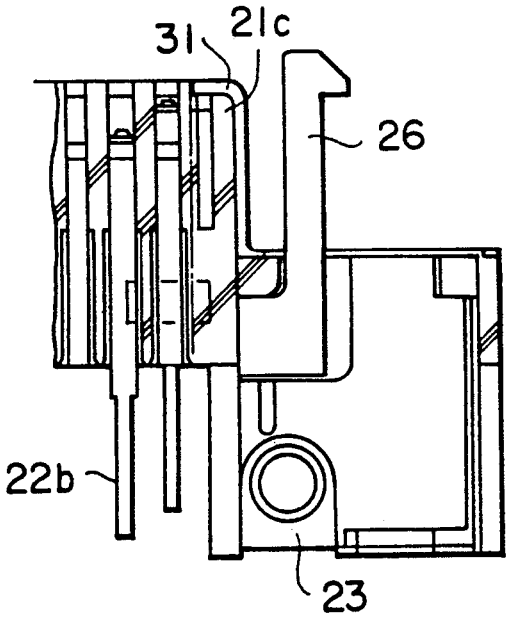
FIG. 11 is a sectional plan view of a locking block in a position attached to the insulator.
Figure 12:
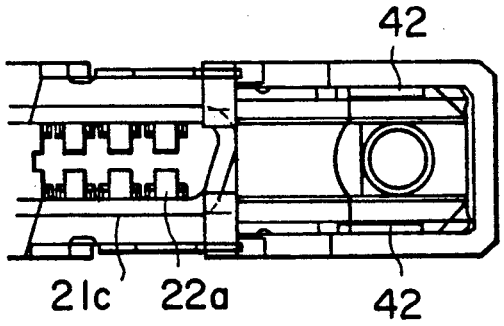
FIG. 12 is a sectional bottom view of the locking block shown in FIG. 11.

As shown in FIGS. 6 and 7, the locking block 23 is provided with the first and the second slots 23*a* and 23*b* for engagement with a hook pin 29 to be locked to a circuit board 28. More specifically, these slots 23*a* and 23*b* are provided across a screw hole 30 in opposite surfaces of the locking block which are parallel to the mounting face 24*b*. The hook pin 29 is provided with a pair of hooks 29*a* for engagement with the first and the second slots 23*a* and 23*b*, and a pair of legs 29*b* for engagement with the circuit board 28. A bolt may be applicable through the screw hole 30 for engagement with the circuit board 28.

The pair of locking blocks 23 are coupled to the end blocks 24 of the insulator 21 in an arrangement symmetric with each other.

A shell 31 is attached to the insulator 21. The shell 31 is provided with a plate section 31*a* in a face-to-face relationship to the main face 21*a* and the receiving faces 24*a* on the insulator 21, and a frame section 31*b* projecting from the plate section 31*a* in an arrangement to cover the coupling section 21*c* of the insulator 21 in assembly. The plate section 31*a* is provided near its opposite ends with a pair of through holes 32 for insertion of the hooks 26 of the locking blocks 23.

As the locking block 23 is received in the receiving space 25 in the end block 24, the locking flaps 27 come into engagement with the locking block 23 in order to inhibit separation of the locking block 23 from the insulator 21. In this state, the shell 31 is attached to the insulator 21. That is, the hook 26 of the locking block 23 is inserted into the through hole 32 in the shell 31. A plurality of projections 34 are formed on the base section 21*b* of the insulator 21 and corresponding engaging holes 31*d* are formed in tongues 31*c* on the shell 31. As a consequence, the projections 34 on the insulator 21 are inserted into the engaging holes 31*d* in the shell 31 in order to fix the shell 31 to the insulator 21.

The electric connector thus assembled is then mounted at the mounting face 24*b* to the base board via a locator 33. The locator 33 is provided with a number of perforations 33*a* receptive of the terminals 22*b* of the contacts 22 on the insulator 21. The terminals 22*b* are kept in electric connection with conductive sections of the circuit board 28. At this mounting, the hook pin 29 is used with its hook 29*a* being in engagement with the first and the second slots 23*a* and 24*b* in the locking block 23 and its legs 29*b* in engagement with holes 28*a* formed in the circuit board 28. As a substitute for such a hook pin 29, a bolt may be used for mounting the electric connector to the circuit board 28. In this case, the bolt is brought into screw engagement with the screw hole 30 in the locking block 23.

The mating connector 8 associated with a cable such as shown in FIG. 2 is coupled to the coupling section 21*c* of the insulator 21. The hook 26 of the locking block 23 comes into locking engagement with the locking flap 17 of the mating connector 8.

It will be clear from the foregoing description that the locking blocks 23 coupled to both ends of the insulator in a symmetric arrangement are interchangeable.

Since the locking blocks 23 are formed separate from the insulator 21, change in size of the insulator 21 due to change in number of contacts 22 does not necessitate change in size of the locking block 23. In other words, one type of locking block 23 can span insulators 21 of various types, thereby significantly reducing the number of parts to be reserved for connectors of different sizes.

Another embodiment of the electric connector in accordance with the present invention is shown in FIGS. 8 to 12. Except for the constructions of the end blocks 24 and the locking blocks 25, the other parts of the electric connector are substantially same as those of the embodiment shown in FIGS. 3 to 7, and are shown by the same reference numerals.

The end block 24 is provided with a cutaway 40 in its rear face opposite to the receiving face 24*a* whereas the locking block 23 is also provided with a side slot 41 which is registered with the cutaway 40 when the locking block 23 is inserted into the receiving space 25 in the end block 24. The cutaway 40 and the side slot 41 receive an edge of the circuit board 28. The end block 24 is formed with a hook piece 42 in its side wall in parallel to the receiving face 24*a* for engagement with the locking block 23. A screw hole 43 is further formed in the locking block 23 which extends between the opposite surfaces in parallel to the mounting surfaces 24*b* for insertion of a bolt which extends through a hole 45 in the circuit board 28 for securing the locking block 23 with the circuit board 28.

In assembly, the circuit board 28 is inserted between the terminals 22*b* of the contacts 22 so that the terminals 22*b* are brought into electric contact with conductive sections formed on the both surfaces of the circuit board 28. This connection is established when the circuit board 28 is received in the cutaway 40 in the end block 24 and the side slots 41 in the side blocks 23.

What is claimed is:

1. An electric connector for mounting on a circuit board, said electric connector comprising:

an insulator (21) comprising a central base section (21*b*) with a main face (21*a*), a coupling section (21*c*) formed on the main face of said base section for coupling with a mating connector (8), and a pair of end blocks (24) formed on opposite ends of said base section, each of said end blocks having a receiving face (24*a*) extending n parallel to the main face, a mounting face (24*b*) substantially perpendicular to the main face, and a receiving space (25) extending substantially perpendicular to said receiving face and parallel to said coupling section;

a plurality of conductive contacts (22) mounted in said coupling section of said insulator;

a pair of locking blocks (23) received in said receiving spaces in said end blocks of said insulator, each of said locking blocks having a hook (26) projecting from said receiving face for making a locking engagement with said mating connector, each of said locking blocks having first and second hook pin retainer slots (23*a*, 23*b*) respectively formed in opposite surfaces thereof and in parallel with said mounting face for engagement with a hook pin (29) to lock said connector to said circuit board; and means (27) for detachably engaging each of said locking blocks and each of said end blocks with each other for keeping each locking block in the receiving space in each end block.

2. An electric connector as claimed in claim 1, in which said hook pin comprises a pair or hooks (29*a*) for engagement with said first and said second slots in said locking block and a pair of legs (29*b*) for locking engagement with said circuit board.

3. An electric connector as claimed in claim 1, in which each of said locking blocks has a through hole (30) extending between opposite surfaces of said locking block, and in parallel with said mounting face for receiving a bolt to secure said locking block to said circuit board.

4. An electric connector as claimed in claim 1, in which said locking blocks are coupled to said end blocks of said insulator in an arrangement symmetric with each other.

5. An electric connector for mounting on a circuit board, said electric connector comprising:

an insulator (21) comprising a central base section (21*b*) with a main face (21*a*), a coupling section (21*c*) formed on the main face of said base section for coupling with a mating connector (8), and a pair of end blocks (24) formed on opposite ends of said base section, each of said end blocks having a receiving face (24*a*) extending in parallel to the main face, a mounting face (24) substantially perpendicular to the main face, and a receiving space (25) extending substantially perpendicular to said receiving face and parallel to said coupling section;

a plurality of conductive contacts (22) mounted in said coupling section of said insulator;

a pair of locking blocks (23) received in said receiving spaces in said end blocks of said insulator, each of said locking blocks having a hook (26) projecting from said receiving face for making a locking engagement with said mating connector, each of said end blocks being provided with a cutaway (40) in a surface opposite to the receiving face, each of said locking blocks being provided with a side slot (41) which is registered with said cutaway when said locking block is coupled to said end block, said cutaway and said side slot adapted to receive therein an edge of said circuit board; and means (27) for detachably engaging each of said locking blocks and each of said end blocks with each other for keeping each locking block in the receiving space in each end block.

6. An electric connector as claimed in claim 5, in which said locking blocks are coupled to said end blocks of said insulator in an arrangement symmetric with each other.

* * * * *